US011142857B2

(12) United States Patent
Lv et al.

(10) Patent No.: US 11,142,857 B2
(45) Date of Patent: Oct. 12, 2021

(54) WASHING MACHINE HAVING SEPARATE WASHING ARRANGEMENTS

(71) Applicant: QINGDAO HAIER WASHING MACHINE CO., LTD., Qingdao (CN)

(72) Inventors: Peishi Lv, Qingdao (CN); Kaiming Wang, Qingdao (CN); Yingxi Zhu, Qingdao (CN); Qingming Zhai, Qingdao (CN); Xuguang Yang, Qingdao (CN)

(73) Assignee: CHONGQING HAIER DRUM WASHING MACHINE CO., LTD., Chongqing (CN)

( * ) Notice: Subject to any disclaimer, the term of this patent is extended or adjusted under 35 U.S.C. 154(b) by 968 days.

(21) Appl. No.: 15/737,347

(22) PCT Filed: Nov. 30, 2015

(86) PCT No.: PCT/CN2015/095910
§ 371 (c)(1),
(2) Date: Feb. 12, 2018

(87) PCT Pub. No.: WO2016/201906
PCT Pub. Date: Dec. 22, 2016

(65) Prior Publication Data

US 2018/0171524 A1 Jun. 21, 2018

(30) Foreign Application Priority Data

Jun. 16, 2015 (CN) ..... 201510332543.8

(51) Int. Cl.
*D06F 29/00* (2006.01)
*D06F 34/28* (2020.01)
(Continued)

(52) U.S. Cl.
CPC ..... *D06F 29/00* (2013.01); *D06F 34/28* (2020.02); *D06F 35/007* (2013.01); *D06F 37/04* (2013.01); *D06F 37/12* (2013.01); *D06F 37/18* (2013.01)

(58) Field of Classification Search
None
See application file for complete search history.

(56) References Cited

U.S. PATENT DOCUMENTS 947,700 A * 1/1910 Raymond
D566,347 S * 4/2008 Cao ..... D32/1

FOREIGN PATENT DOCUMENTS

CN 201339117 Y * 11/2009

* cited by examiner

*Primary Examiner* — Rita P Adhlakha
(74) *Attorney, Agent, or Firm* — Jiwen Chen; Jacobson Holman PLLC

(57) ABSTRACT

A washing machine having separate washing arrangements, comprising a housing (1), and, arranged within said housing (1), a first automatic washing system (2) and a second automatic washing system (3). The housing (1) contains a first washing area (4) for accommodating the first automatic washing system (2) and a second washing area (5) for accommodating the second automatic washing system (3), said first washing area (4) and second washing area (5) being arranged one on the left and the other on the right. The axis of the first automatic washing system (2) and the axis of the second automatic washing system (3) are vertical. A user may choose according to need whether to operate one automatic washing system or both automatic washing systems at the same time; as the working principles and modes of installation of said two systems are different, during washing processes, the direction of sway and amplitude of sway of each accommodating drum accommodating wash water are different, hence the distance at which said two
(Continued)

accommodating drums are arranged one away from the other is reduced. The direction and the location of the forces to which the housing (1) is subjected also are different, thus avoiding that vibration and forces occasioned by concurrent operation of the two washing systems directly combine; the forces received by the housing (1) being thus more dissipated, deformation of the housing (1) is avoided.

14 Claims, 22 Drawing Sheets

(51) Int. Cl.

| | |
|---|---|
| ***D06F 37/18*** | (2006.01) |
| ***D06F 35/00*** | (2006.01) |
| ***D06F 37/04*** | (2006.01) |
| ***D06F 37/12*** | (2006.01) |

WASHING MACHINE HAVING SEPARATE WASHING ARRANGEMENTS

This is a U.S. national stage application of PCT Application No. PCT/CN2015/095910 under 35 U.S.C. 371, filed Nov. 30, 2015 in Chinese, claiming priority of Chinese Application No. 201510332543.8, filed Jun. 16, 2015, all of which are hereby incorporated by reference.

TECHNICAL FIELD

The present invention belongs to the technical field of washing machine, in particular to a washing machine having the sorting laundry function.

BACKGROUND

Washing machines have become our necessities of life at present, and generally each family has a washing machine. However, in our daily life, it is suggested that different types of clothes should not be washed together. Clothes should be sorted and washed separately: coat and underwear should be washed separately; baby's clothes and adult's clothes should be washed separately; and all clothes should be sorted with colors, soil levels and materials. Apparently it takes a long time to run wash progress multiple times after sorting, especially if there are more clothes needs to be washed. Moreover, a preferred washing machine has not been provided for the requirement that only small items, underwear or baby's clothes to be washed. In consideration of space, people are reluctant to buy another washing machine, however it takes more time and efforts to wash part of them by hand, especially clothes is hard to rinse clean by hand-washing.

The mainstream drum-type or pulsator-type washing machine on the market have its own advantages and disadvantages: on one hand, the drum-type washing machine simulates the action of rubbing by hand with an even clean effect, a low clothes wear rate, and the structure of the drum-type washing machine could prevent clothes being tangled, twisted or knotted; on the other hand, the clean rate of the pulsator-type washing machine is 10% higher than the drum-type and the clothes wear rate is also 10% higher. Comparatively, washing time of the drum-type is longer (1-2 hours) than the tubular-type (about 40 minutes), and the laundry could be added even the washing process is started. If a short washing time is needed, it is recommended to buy a pulsator-type washing machine; if have more dedicates, such as wool and silk clothing, it is recommended to buy a drum-type washing machine.

TECHNICAL SOLUTIONS

The present invention provides a wash washing machine, in which a first automatic washing system and a second automatic washing system are arranged in a shell, so that the sorting laundry function could be achieved by only one washing machine.

To achieve the above objective, the present invention adopts the following technical solutions:

A washing machine with dual washing systems includes a shell, a first automatic washing system and a second automatic washing system, the first automatic washing system and the second automatic washing system are disposed in the shell; the shell has a first washing area accommodating the first automatic washing system and a second washing area accommodating the second automatic washing system, the first washing area and the second washing area are arranged along the direction from left to right; the axis of the first automatic washing system is perpendicular to the axis of the second automatic washing system.

Further, the axis of the first automatic washing system and the axis of the second automatic washing system are perpendicular to each other but are not intersecting.

Further, one of the first automatic washing system and the second automatic washing system is an automatic drum-type washing system, and the other one is a tubular automatic washing system, and a water supply system and a drainage system is used by the first automatic washing system and the second automatic washing system together.

Further, a control system controls the first automatic washing system and the second automatic washing system and the spin cycle of the first automatic washing system and the second automatic washing system starts at different time under the control of the control system.

Further, the washing capacity of the first automatic washing system is larger than that of the second automatic washing system.

Further, the shell has an auxiliary functional area adjacent to the first washing area and the second washing area.

Further, the auxiliary functional area is half-enclosed by the first washing area and the second washing area.

Further, the auxiliary functional area and the second washing area are arranged back and forth.

Further, the auxiliary functional area and the first washing area are disposed along the direction from left to right.

Further, the auxiliary functional area is provided with a storage module.

Further, the auxiliary functional area is provided with a health module.

Further, the auxiliary functional area is provided with a third automatic washing system.

Further, the washing machine further has a display operation module disposed on the top of the auxiliary functional area.

Further, the first automatic washing system is a drum-type automatic washing system and the second automatic washing system is a tubular automatic washing system.

Further, the first automatic washing system is a tubular automatic washing system, and the second automatic washing system is a drum-type automatic washing system.

Further, the first automatic washing system comprises a first washing cylinder, the second automatic washing system comprises a second washing cylinder, and the minimum distance between the first washing cylinder and the second washing cylinder is 15 mm to 30 mm.

Preferably a minimum distance between the first washing cylinder and the second washing cylinder is 25 mm.

Further, the shell includes a left side plate, a right side plate, a back plate, and an L-shaped sealing plate, the front end of the left side plate is bent to the right and extended to form a front plate, the rear end of the left side plate is bent to the right to form a right rear plate; the rear end of the right side plate is bent to the left to form a left rear plate, the back plate is arranged between the right rear plate and the left rear plate; the L-shaped sealing plate has a first portion in the front-rear direction in which the front plate is connected to, and a second portion in the left-right direction in which the right side plate is connected to.

Further, an upper middle beam is disposed between the front plate and the back plate of the shell, and a front portion of the upper middle beam is disposed on the top of the first portion of the L-shaped sealing plate.

Further, the ratio of the distance from the upper middle beam to the left side of the shell to the distance from the upper middle beam to the right side of the shell is 5:3~2:1.

Further, a vertical plane where the upper middle beam in divides the space enclosed by the shell into two washing area from left to the right, the first automatic washing system is located in the first washing area on the left, and the second automatic washing system is located in the second washing area on the right.

Further, the second automatic washing system includes the second washing cylinder, an outer cylinder cover is arranged on the second washing cylinder, a clothes access and an inner cover sliding to open and close the clothes access are provided on the outer cylinder cover and a receiving area for receiving the opening inner cover is provided inside the shell.

Further, another receiving portion for receiving the inner cover sliding horizontally from the position closing the clothes access to the position opening the clothes access is provided inside the shell.

Further, the left and right ends of the inner cover extend outwardly forming sliding pieces along the horizon direction, and two pressing pieces are provided on the outer cylinder cover on the left and right sides of the clothing access, a sliding trail receiving one of the sliding piece is provided between one of the pressing piece and the outer cylinder cover.

Further, the sliding piece includes an upward flange, the inner side of the pressing piece has a downward flange, and the upward flange is located outside the downward flange.

Further, the pressing piece further has a vertical downward baffle and the upward flange is located in the area enclosed by the pressing piece, the vertical downward baffle and the downward flange.

Further, the outer cylinder cover is provided with a plurality of mounting cylinders for arranging the pressing piece, and a connecting plate connecting any two of the mounting cylinders is disposed between the adjacent mounting cylinders.

Further, a positioning structure is provided between the inner cover and the outer cylinder cover in cooperation, and the positioning structure includes a positioning cylinder and a slot.

Further, the mounting cylinder is arranged at the front of the outer cylinder cover and the slot is arranged on the lower surface of the inner cover, one end of the slot is provided with a claw bent inwards, one end of the claw is provided an outward flange, and the other end of the slot extends outwardly to form a guiding portion; when the inner cover slides to the closing position, the mounting cylinder is located in the slot.

Further, the inner cover is of an upward arched structure, and the periphery of the inner cover extends outwardly to form a horizontal sealing edge.

Further, the outer cylinder cover is provided with a support plate; when the inner cover is opened, the inner cover slides to the support plate from the outer cylinder cover.

Further, the upper surface of the support plate is in the same horizontal plane as the upper surface of the outer cylinder cover.

Further, the rear portion of the outer cylinder cover is provided with a stopper baffle; when the inner cover is in the closing position, the rear end of the outer cylinder cover is attached to the stopper baffle.

Further, the outer cylinder cover is provided with a wiping plate; when the inner cover is opened, the wiping plate removes water droplets from the lower surface of the inner cover.

Further, the upper portion of the wiping plate is attached to the lower surface of the inner cover.

Further, the wiping plate inclines towards the closing direction of the inner cover and is tilted upwardly by a certain angle.

Preferably, an angle formed by the wiping plate and the outer cylinder cover is 10° to 30°.

BENEFITS AND ADVANTAGES

The washing machine with dual washing systems provided by the present invention includes a first automatic washing system and a second automatic washing system which are arranged in a shell, therefore two sets of automatic washing systems are provided in one washing machine, so that the function of sorting washing could be fulfilled. According to requirements, the user could start one automatic washing system or two automatic washing systems simultaneously. The axis of the first automatic washing system is perpendicular to the axis of the second automatic washing system, therefore the working principles and installation methods of the two automatic washing systems could be different and the direction and amplitude of shaking of the washing cylinders with washing water are different, so that the spacing between the two washing cylinders can be set comparatively small and the force exerted on the shell and force bearing point could be different to avoid the forces and amplitude produced by two automatic washing systems added, and the force is scattered on the shell to avoid deformation.

Other features and advantages of the present invention will become more apparent referring to the following detailed description of the present invention in conjunction with the drawings.

EMBODIMENTS OF THE PRESENT INVENTION

To make the objectives, technical solutions, and advantages of the embodiments of the present invention clearer, the technical solutions in the embodiments of the present invention will be described clearly and completely with reference to the accompanying drawings in the embodiments of the present invention.

In the description of the present invention, it should be noted that the directions or position indicated by the terms "up", "down", "left", "right", "front" and "back" is merely for convenience in describing the present invention and simplifying the description, rather than indicating or implying that the indicated apparatus or portion must have a specific orientation and be constructed and operated in a specific orientation, and therefore should not be construed as limiting the present invention. In addition, the terms "first" and "second" are used for descriptive purposes only and are not to be construed as indicating or implying relative importance.

Figure 1:
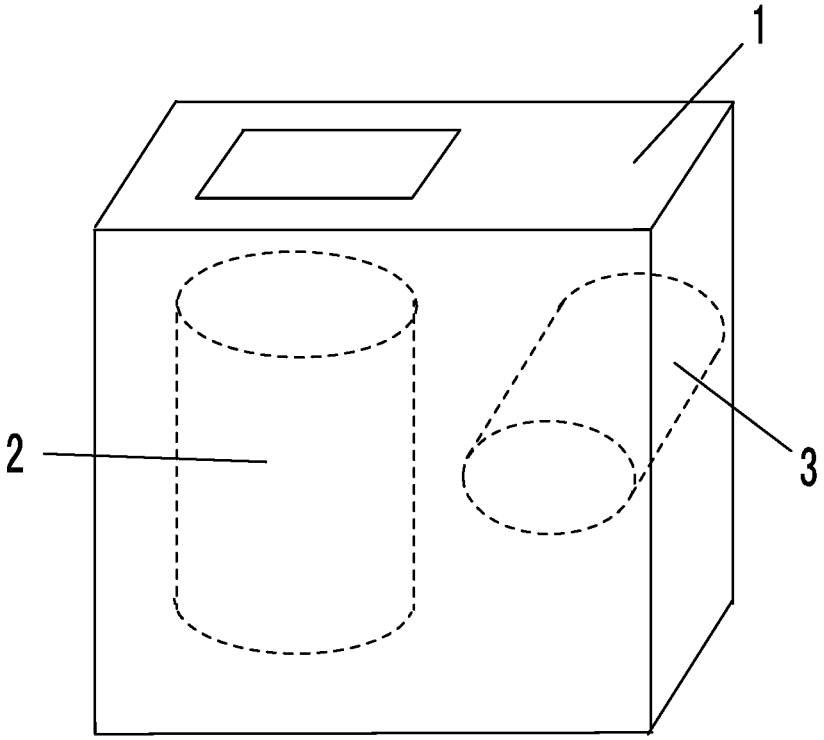
FIG. 1 is a schematic structural view of a first embodiment of the washing machine with dual washing systems according to the present invention.
Figure 2:
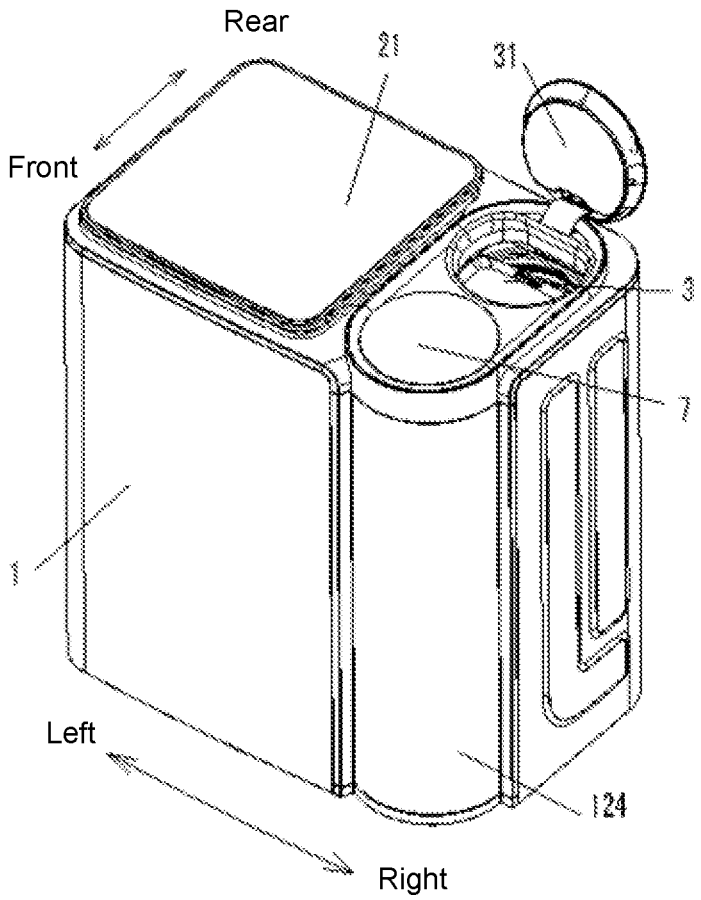
FIG. 2 is a schematic structural view of a second embodiment of the washing machine according to the present invention.

Referring to FIG. 1, a first embodiment of a washing machine according to the present invention is provided, the washing machine with dual washing systems comprises a shell 1, and a first automatic washing system 2 and a second automatic washing system 3. The first automatic washing system 2 and the second automatic washing system 3 are arranged in the shell 1, so that sorted clothes could be washed by different washing systems separately, thereby being of advantageous in energy saving, health and hygiene, further could save the laundry time.

The axis of the first automatic washing system 2 and the axis of the second automatic washing system 3 are arranged along the direction from left to right; the axis of the first automatic washing system 2 is perpendicular to the axis of the second automatic washing system 3, namely the axis of a set of automatic washing systems is a the horizontal plane, such as a drum-type washing system, and the axis of the other automatic washing system is in a vertical plane, such as a pulsator-type washing system. These arrangements, as well as the different working principle and installation method of the automatic washing systems could prevent the collision of the two washing cylinders retaining water caused by the direction and the amplitude of shaking, so that the spacing between the two washing cylinders could be set much smaller. Therefore the force exerted on the shell and force bearing point could be different so as to avoid the forces and amplitude produced by two automatic washing systems added, and the force is scattered on the shell to avoid deformation.

In this embodiment, the axis of the first automatic washing system 2 and the axis of the second automatic washing system 3 are perpendicular to each other but are not intersecting, or perpendicularly to each other in different planes.

In some illustrative embodiments, a water supply system and a drainage system of the washing machine is used by the first automatic washing system 2 and the second automatic washing system 3 together. Only one set of water supply system and drainage system could reduce parts used in the washing machine and saving the inner space of the shell 1, and reduce the cost in material.

In some illustrative embodiments, the outer cylinder of the automatic washing system may shake comparatively violently when it enters the spin cycle. In order to prevent collusion of the two automatic washing systems, a control system is provided in the washing machine of the present invention, the control system sets the two automatic washing systems entering into spin cycle at different time. If the user selects to use the two automatic washing systems and the two automatic washing systems response to the setting time of spinning at the same time, the control system will enable one of them into the spin cycle, and then delay 2 to 3 seconds to enable the other one into the spin cycle. The user is oblivious to the delay and it does not have impact on user experience.

In this embodiment, the first automatic washing system 2 is a pulsator-type fully automatic washing system and the second automatic washing system 3 is a fully drum-type automatic washing system. The first automatic washing system 2 has a first washing cylinder retaining washing water and the second automatic washing system 3 has a second washing cylinder retaining washing water. Since the automatic washing cylinders vibrate in washing cycle, especially in spinning cycle, a sufficient distance between the first washing cylinder and the second washing cylinder should be kept to prevent bumping into each other and resulting in wearing or damage. In this embodiment, a minimum distance between the first washing cylinder and the second washing cylinder is 15 mm to 30 mm, and preferably 25 mm. Such a comparatively small distance is relied on the enhancement the stability of the outer cylinder when the automatic washing system is working, and also on the control method to enable the two washing cylinders to enter into the spin cycle at different setting time.

Referring to FIG. 2 to FIG. 20, the second embodiment of the washing machine according to the present invention is provided, the main difference between this embodiment and the first embodiment is that, in this embodiment, the first automatic washing system 2 is a drum-type automatic washing system, the second automatic washing system 3 is a pulsator-type washing system, the other arrangements are as same as the first one.

The washing machine with dual washing systems comprises a shell 1, a first automatic washing system 2 and a second automatic washing system 3 which are arranged in the shell 1, the first automatic washing system 2 is the drum-type washing system. The area containing the first automatic washing system 2 is defined as a first washing area 4, and the area containing the second automatic washing system 3 is defined as the second washing area 5, in which the first washing area 4 and the second washing area 5 are arranged along the direction from left to right, namely, the two automatic washing systems are aligned left and right; the first automatic washing system 2 is a drum-type washing system with a horizontal axis and the second automatic washing system 3 is a pulsator-type washing system with a vertical axis, so that the axis of the first automatic washing system 2 and the axis of the second automatic washing are in different panels but perpendicular to each other. The working principles and installation methods of the two automatic washing systems are different, and the direction and amplitude of shaking of the two washing cylinders with washing water are different, so that the spacing between the two washing cylinders can be set comparatively small, and therefore the force exerted on the shell and force bearing point could be different so as to avoid the forces and amplitude produced by two automatic washing systems added, and the force is scattered on the shell to avoid deformation.

In this embodiment, the washing capacity of the first automatic washing system 2 is greater than that of the second automatic washing system 3, that is to say, two washing systems with different washing capacities. Hence the second automatic washing system 3 could be used to wash small items or only merely a few of clothes. Because two sets of automatic washing systems have different washing capacities, the space occupied by the two sets of automatic washing systems are different, that is, the first washing area 4 is larger than the second washing area 5. In order to make better use of the space in the shell 1, the shell 1 further has an auxiliary functional area 6 adjacent to the first washing area 4 and the second washing area 5. It is a reasonable arrangement to set the auxiliary functional area 6 in the shell 1 because the inner space of the shell could be better utilized in this way.

In some illustrative embodiments, the auxiliary functional area 6 is configured as a storage module, and to be specific, a storage cabinet is disposed at the auxiliary functional area 6 for placing detergents and it is convenient for the user. A health module may also be arranged in the auxiliary functional area 6, for example, a sterilization and disinfection module to sanitize or disinfect washed clothes. In addition, the auxiliary functional area 6 may also be provided with a third automatic washing system. The washing capacity of the third automatic washing system may be equal to or smaller than the washing capacity of the second automatic washing system, so that could be performed in a more dedicate way, such as the third automatic washing system is tailored to wash baby's clothes and adult's underwear.

In some illustrative embodiments, the auxiliary functional area 6 is disposed adjacent to the second washing area 5 in the front-to-back direction, and adjacent to the first washing area 4 in the left-to-right direction, that is to say, the auxiliary functional area 6 is half-surrounded by the first washing area 4 and the second washing area 5, or namely the length of the auxiliary functional area 6 and the second washing area 5 from front to back is equal to the length of the first washing area 4 from front to back. Specifically, in the shell 1, the left side is the first washing area 4, the right back side is the second washing area 5, and the right front side is the auxiliary functional area 6. The front-rear position of the second washing area 5 and the auxiliary functional area 6 also could be switched over, or the first washing area 4 may be disposed at the right side inside the shell.

Figure 3:
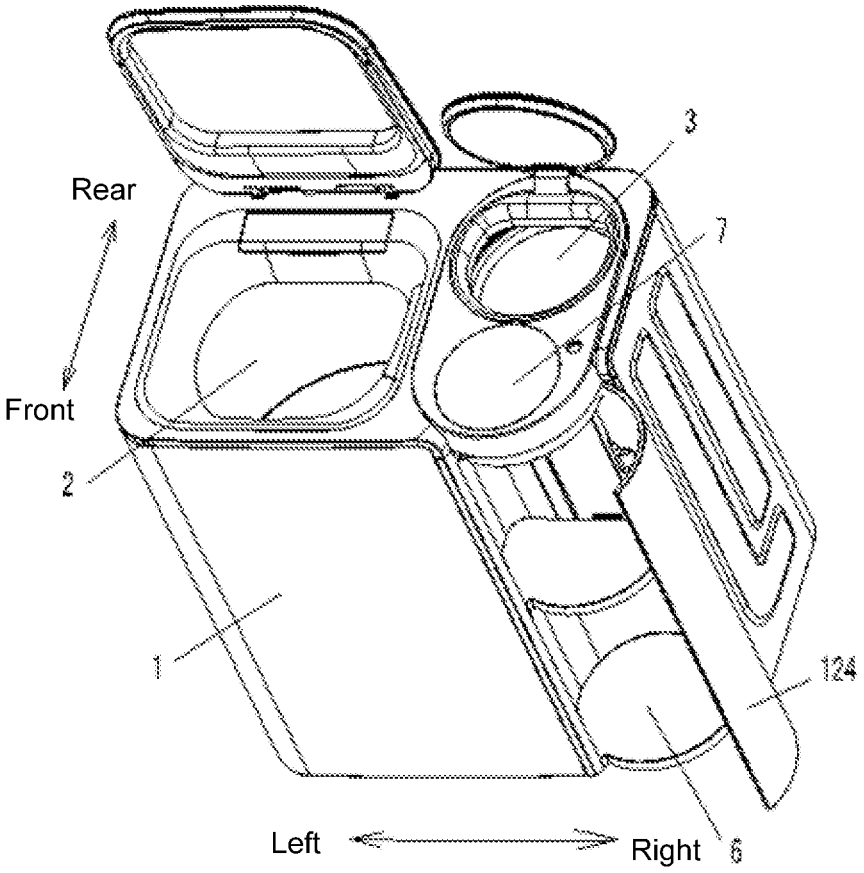
FIG. 3 is a schematic structural view of the washing machine of FIG. 2 in a different state.
Figure 4:
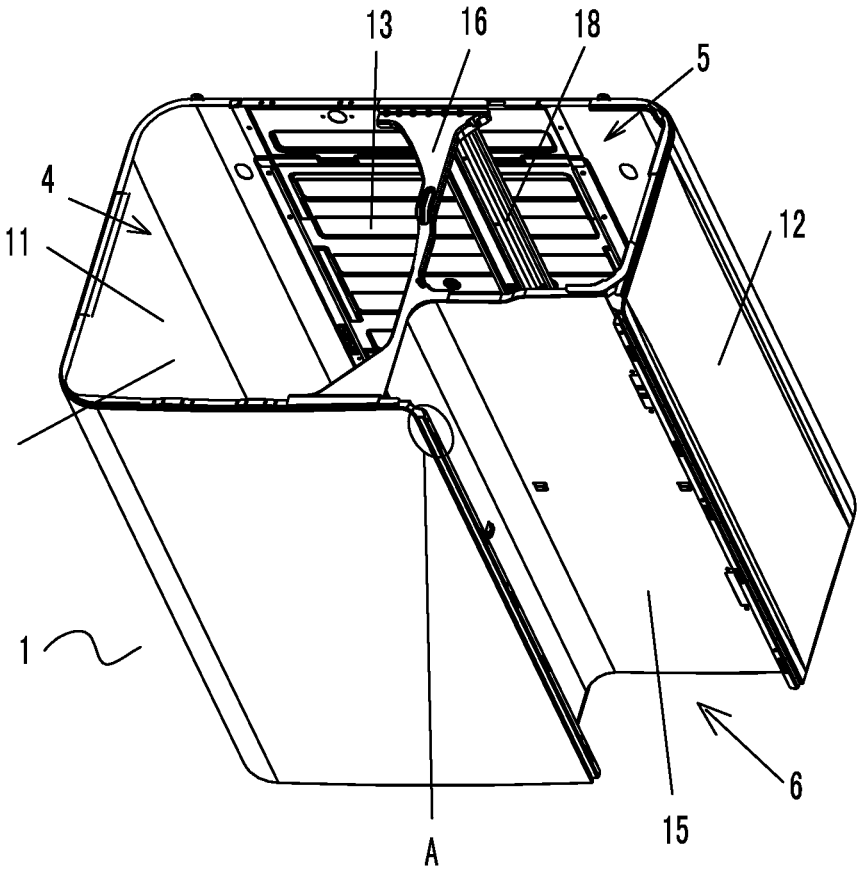
FIG. 4 is a schematic structural view of the shell in FIG. 1.

Referred to the FIG. 3 to FIG. 4, the left side of the shell 1 is the first washing area 4, the right rear side is the second washing area 5, the right front side is the auxiliary functional area 6, and the auxiliary functional area 6 is provided with the storage cabinet. In consideration of the appearance, the auxiliary functional area 6 is designed with in an arc-like shape, that is to say, the shell 1 is curved at the front right corner. A door cover 21 for opening and closing the clothes access of the first automatic washing system 2 is provided on the top of the first washing area 4. An upper cover 31 for opening and closing clothes input port of the second automatic washing system 3 is provided on the top of the second washing area 5. That is to say, the top of the shell 1 is provided with the door cover 21 and the upper cover 31. Considering the appearance and convenience, only one display operation module 7 for two sets of automatic washing systems is provided and disposed on the top of the auxiliary functional area 6. Separate buttons and touch-screen options for two automatic washing systems are arranged on the display operation module 7. The display operation module 7 respectively connects to a first control module controlling the first automatic washing system 2 and to a second control module controlling the first automatic washing system 3. The arrangement of the display operation module 7 on the top of the auxiliary functional area 6 is concise in appearance, easy for operation and low in manufacturing cost.

As long as the outer diameters of the washing cylinder of the two automatic washing systems are determined, the size of the shell 1 is basically determined due to major part of the inner space occupied by the washing cylinder in the washing machine. In order to reduce the overall size of the shell and meanwhile maintain the minimum distance between the first washing cylinder and the second washing cylinder, it is preferable to arrange the second washing cylinder at a correspondingly backward position to spare more space for the auxiliary functional area 6, and such arrangements could make the inside more compact and reasonable.

The structure of each part of the washing machine in this embodiment will be described in detail below. It should be understood that the structure of each part of the washing machine is not limited to the following embodiments.

Referring to FIG. 4-8, as well as the FIG. 1, the shell 1 is designed to bear the first automatic washing system 2 and the second automatic washing system 3. The shell 1 includes a left side plate 11, a right side plate 12, a back plate 13, a door 124, and an L-shaped sealing plate 15, wherein the front end of the left side plate 11 is bent to the right and extended to form a front plate 111, the rear end is bent to the right and extended to form a right rear plate 112, the rear end of the right side plate 12 is bent to the left and extended to form a left rear plate 121. A back plate 13 is between the right rear plate 112 and the left rear plate 121, that is to say, the right end of the back plate 13 is fixed on the right rear plate 112 and the left end is fixed on the left rear plate 121. The back plate 13 includes a cover, an upper connecting plate and a lower connecting plate. That is to say, the front and rear ends of the left side plate 11 are bent and extended to form the front plate 111 and the right rear plate 112 respectively. The left side plate 11 is a one-piece component and forms the front surface, the left side surface and a part of the rear surface of the shell. The right side plate 12 is also a one-piece component and forms the right side of the shell and part of the back of the shell. Such an independent component have a higher strength with respect to the assembled parts and thus enhances the overall strength of the shell 1, meanwhile the number of parts could be reduced to facilitate installation and also make the shell good in looking.

Figure 8:
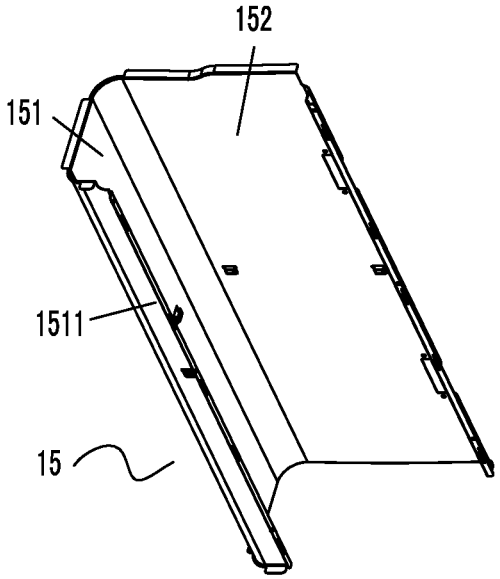
FIG. 8 is an enlarged schematic view of the L-shaped sealing plate of FIG. 4.

As shown in FIG. 8, the L-shaped sealing plate 15 has a first portion 151 connected to the front plate 111 in the front-rear direction and a second portion 152 connected to the right side plate 12 in the left-right direction. By providing the first portion 151 and the second portion 152 of the L-shaped sealing plate 15, the interior of the shell 1 is defined into two adjacent square-shaped areas for accommodating the first automatic washing system and the second automatic washing system. The first portion 151 and the second portion 152 are respectively used for supporting the first automatic washing system and the second automatic washing system. In this way, the supporting strength of the shell 1 in the vertical direction is increased to support the two automatic washing systems to make the shell stable for holding the vertical and horizontal torsion forces exerted by the two working washing systems, as well as the inside space of the shell 1 is divided into different regions.

Figure 5:
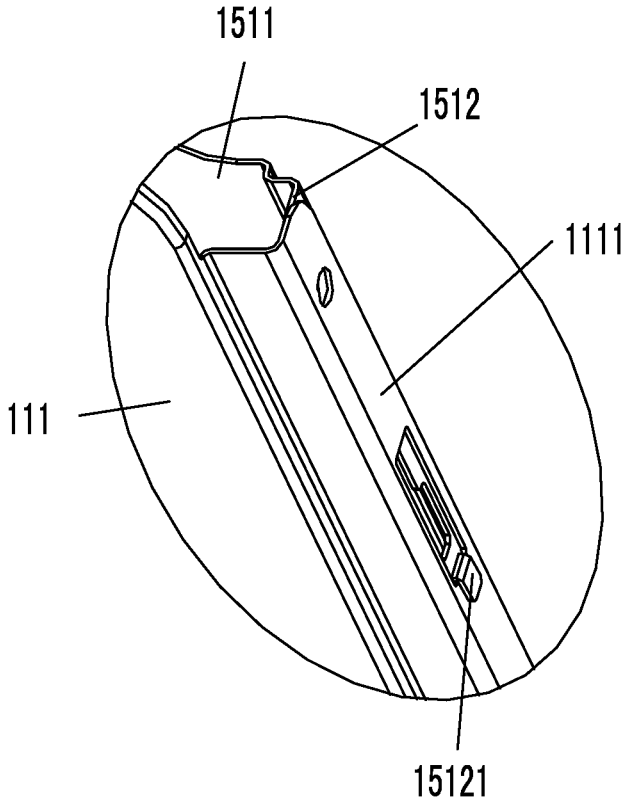
FIG. 5 is an enlarged schematic view of the region A in FIG. 4.
Figure 6:
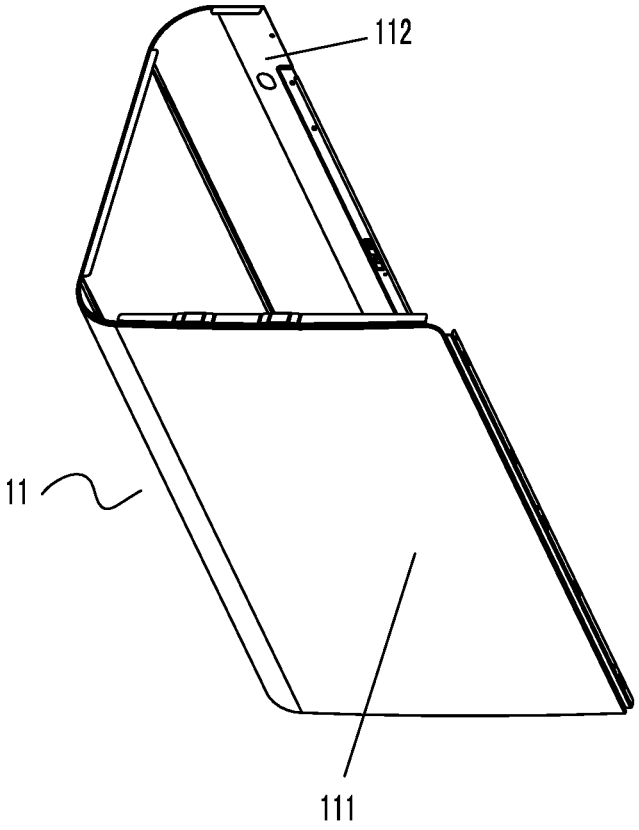
FIG. 6 is a schematic enlarged view of the left side plate of FIG. 4.
Figure 7:
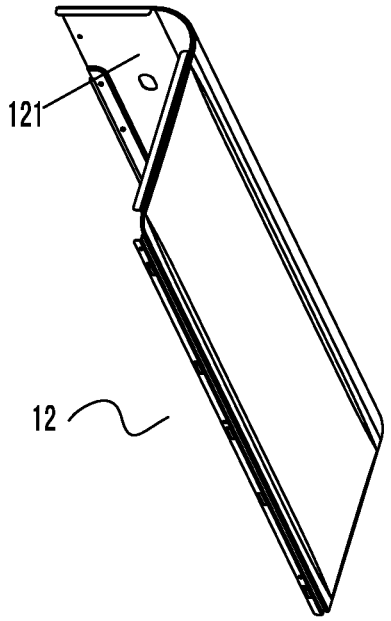
FIG. 7 is a schematic enlarged view of the right side plate of FIG. 8.

In this embodiment, as shown in FIG. 5, the L-shaped sealing plate 15 and the front plate 111 are in clamping connection. To be specific, a first extending portion 1511 bent to the right is provided at the front end of the first portion 151, and a first forward flange 1512 is formed at the end of the first extending portion 1511. A first rearward flange 1111 is provided on the right end of the front plate 111, and the first forward flange 1512 is located inside the first rearward flange 1111. That is to say, the L-shaped sealing plate 15 and the front plate 111 are two layers of plates with certain distance at the section where the first extending portion 1511 formed, and therefore the joint end is formed by the first forward flange 1512 and the first rearward flange 1111. This arrangement does not only enhance the strength of the shell 1, but also makes the joint more beautiful. In order to ensure the firmness of the joint of the first forward flange 1512 and the first rearward flange 1111, an opening is opened on the rearward flange 1111, and a hanging ear 15121 is disposed on the first forward flange 1512 and the hanging ear extend and hangs at the opening. The same connection structure is also used between the L-shaped sealing plate 15 and the right side plate 12.

In this embodiment, the left side plate 11, the right side plate 12, the back plate 13, and the L-shaped sealing plate 15 are made of steel plate. The left side plate 11, the right side plate 12, and L-shaped sealing plate 15 are bent to form the desired shape.

Referring to the FIG. 4, in order to further increase the strength of the shell 1 and support the two automatic washing system, an upper middle beam 16 is provided between the front plate 111 and the back plate 13 of the shell 1. The upper beam 16 is located on the top of the first portion 151 of the L-shaped sealing plate 15. The vertical plane where the upper beam 16 lies in divides the space enclosed by the shell 1 into the left and right washing areas. The first automatic washing system 2 is on the left and the second automatic washing system 3 is on the right. In this way, on one hand, the strength of the shell 1 is further increased by providing the upper middle beam 16 and the middle beam 14 so as to respectively improve the support for the two sets of automatic washing systems in the shell 1, so as to avoid the force deflection on the shell when an automatic washing system works, on the other hand, the inside space of the shell 1 is divided into the left and right washing areas for placing the first automatic washing system 2 and the second automatic washing system 3 respectively. The ratio of the distance from the upper middle beam 16 to the left side of the shell 1 and the distance from the upper middle beam 16 to the left side of the shell 1 is 5:3~2:1.

In this embodiment, a support vertical beam 18 is provided between the rear end of the upper middle beam 16 and the rear end of the lower middle beam 17 to vertically increase the support of the shell 1 and improve the strength of the shell 1.

Figure 9:
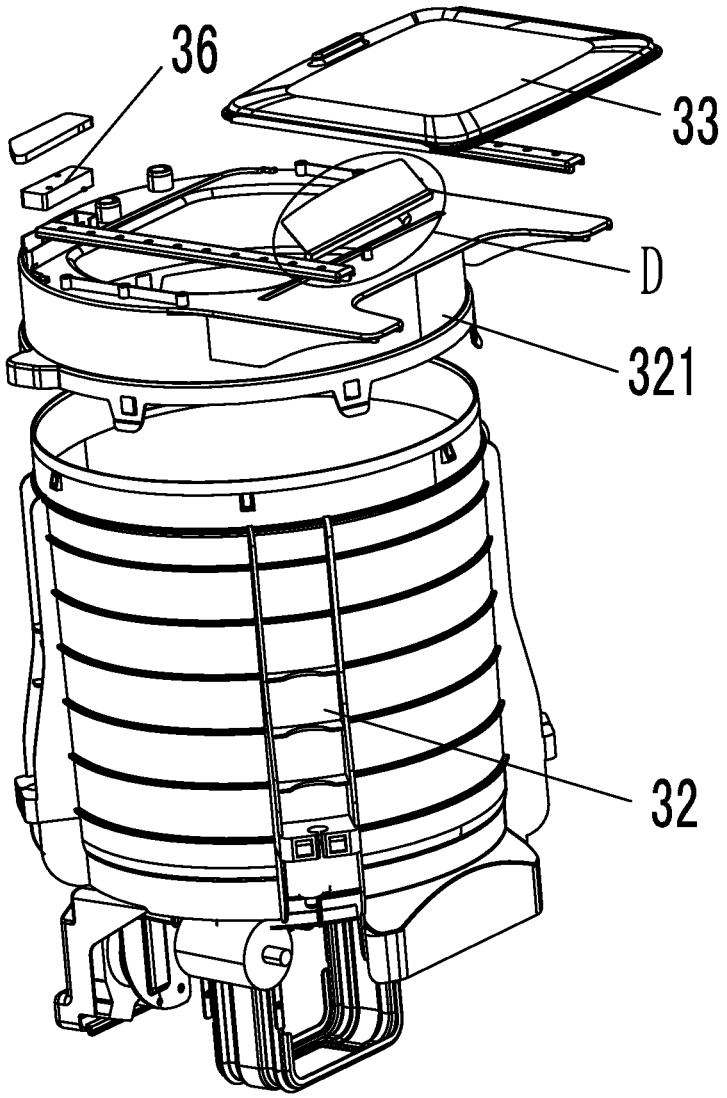
FIG. 9 is an explosive view of part of the structure of the second automatic washing system in FIG. 2.

Referring to FIG. 9 to FIG. 20, the inner cover of the second automatic washing system 3 will be described in details. First, it is assumed that the direction towards the center of the second washing cylinder is "inner" and the direction away from the center of the second washing cylinder is "outer". The second washing cylinder 32 of the second automatic washing system 3 has an outer cylinder cover 321, and a clothes access 3211 for putting in laundry is disposed on the top of the outer cylinder cover 321. In this embodiment, the second automatic washing system 3 has a heating function. In order to avoid the leakage of water vapor in washing cycle, and also prevent the laundry in the outer cylinder from being thrown out during the high-speed operation, the outer cylinder cover 321 is provided with a removable inner cover 33 and the inner cover 33 slides to open or close the clothes access 3211. It is defined that the inner cover 33 has a closing position where the clothes access 3211 is being closed and an opening position where the clothes access 3211 is being opened. A receiving area which accommodates the inner cover 33 when the inner cover 33 horizontally slides from the closing position to the opening position is provided. By arranging the receiving area in the shell 1, the sliding inner cover 33 could be arranged on the outer cylinder cover 321, which avoids problems caused by turnover cover: unaesthetic design of reinforcing ribs below the inner cover, occupied space and tangling clothes when taken out and the like. Referring to FIG. 9, the inner cover 33 is arranged to slide in the front-rear direction. When the inner cover 33 slides forwards, the clothing access 3211 is opened, and the inner cover 33 slides to the receiving area reserved above the storing cabinet, that is to say, the receiving area is a part of the room on the upper side of the auxiliary functional area 6 inside the shell 1 so that the storage cabinet is arranged in the space of the auxiliary functional area 6 below the receiving area.

Figure 11:
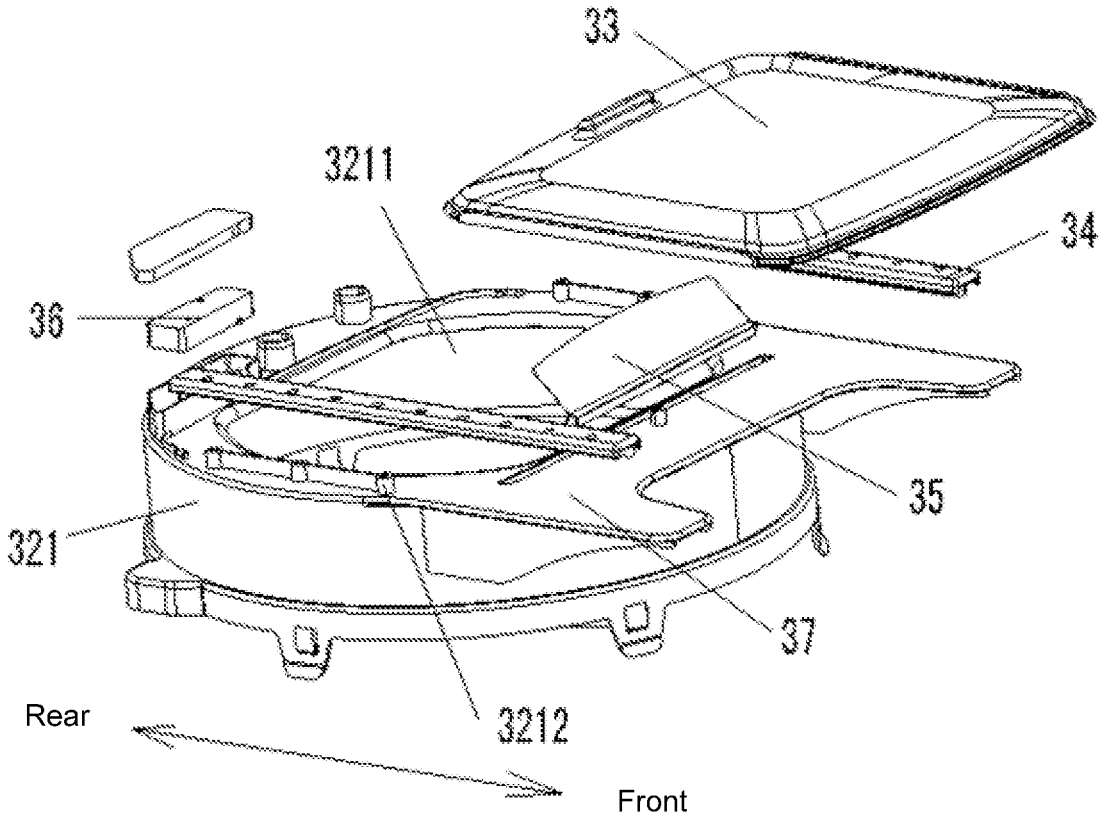
FIG. 11 is a schematic enlarged view of the outer cylinder cover of FIG. 9.
Figure 12:
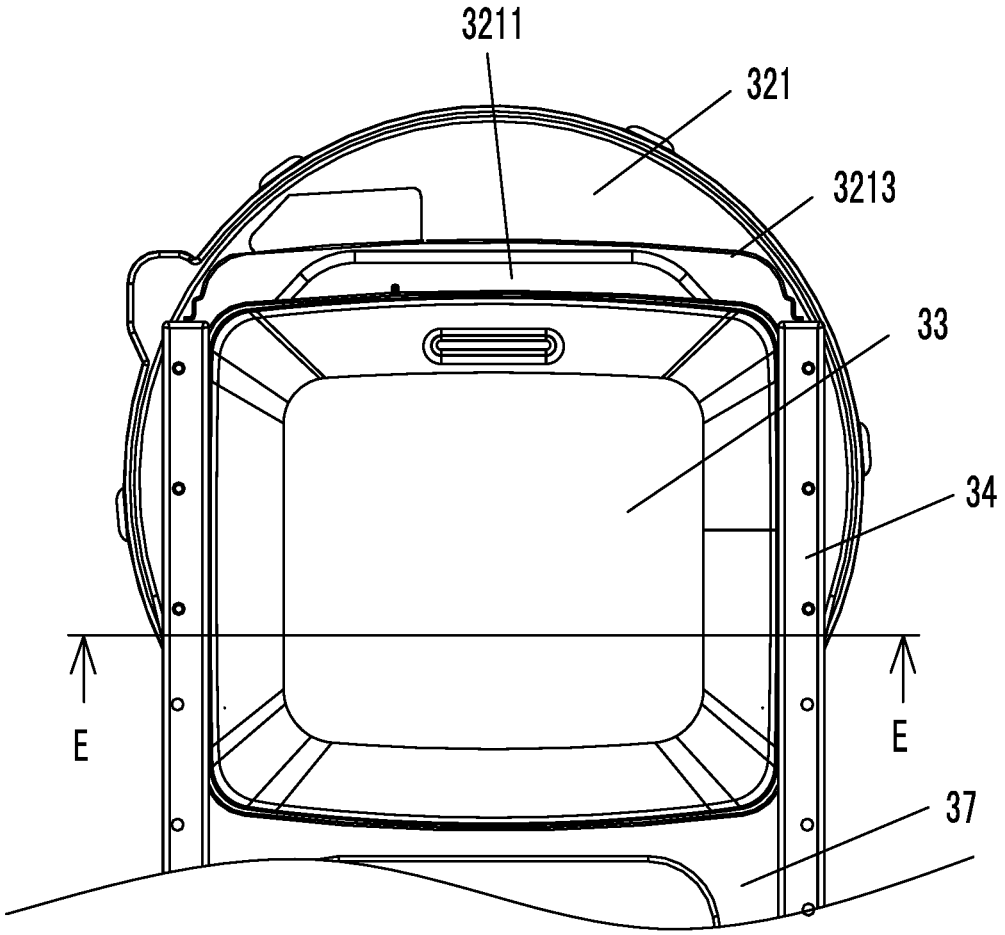
FIG. 12 is a plan view of the structure shown in FIG. 11 after installation.

The inner cover 33 is an integral inner cover to make the structure simple and the overall strength great. Two parallel pressing pieces 34 are disposed on the outer cylinder cover 321 on both of the left and right sides of the clothes access 3211, the pressing pieces 34 are arranged back and forth, and a sliding trail for sliding the inner cover 33 is formed between the pressing piece 34 and the outer cylinder cover 321; the left and right ends of the inner cover 33 extend outwardly to form horizontal sliding pieces 331. The sliding piece 331 slides back and forth in the sliding trail, so that the inner cover 33 opens or closes the clothes access 3211, as shown in FIG. 11 to FIG. 12.

Figure 13:
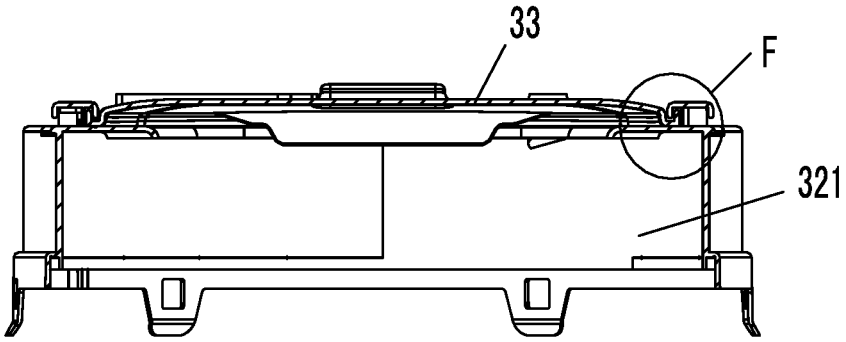
FIG. 13 is a cross-sectional schematic view of FIG. 12 along the line E-E.
Figure 14:
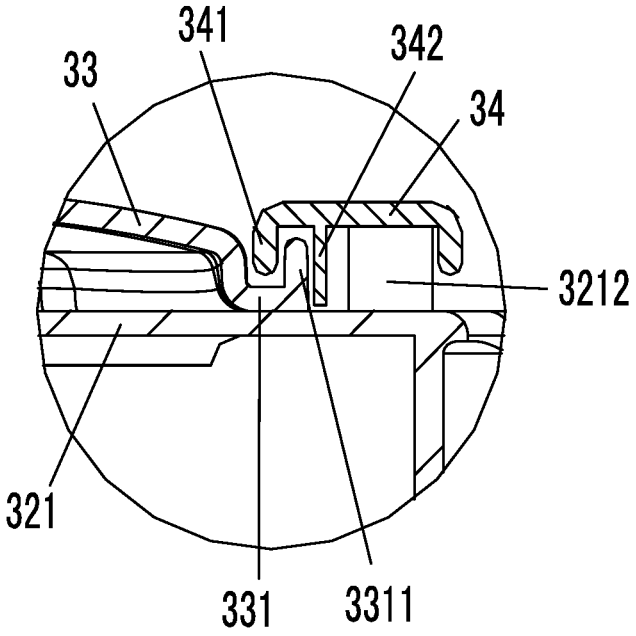
FIG. 14 is an enlarged schematic view of the F region in FIG. 13.

In order to further increase the tightness between the inner cover 33 and the outer cylinder cover 321, the structure of the pressing piece 34 and the sliding piece 331 is provided. The edge of the sliding piece 331 is provided with an upward flange 3311, that is to say, a flat "L" structure is formed when the flange 331 is provided with the upward flange 3311. The inner side of the pressing piece 34 has a downward flange 341, that is to say, a flat "L" structure is formed when the pressing piece 34 is provided with the downward flange 341, and the two "L" structures engages with each other, or that is to say the upward flange 3311 located outside of the downward flange 341. By arranging the pressing piece 34 and the sliding piece 331 engaged with each other, the connection between the inner cover 33 and the pressing piece 34 is more compact, the stability when the inner cover 33 slides back and forth is ensured, and at the same time, when the inner cover 33 is in the closing position, the water vapor in the second washing cylinder 32 is not easily leaked through the sliding piece 331. In order to further prevent leakage of water vapor from the gap between the inner cover 33 and the outer cylinder cover 321 when the second automatic washing system enters into heat cycle, a vertical downward baffle 342 is further disposed on the pressing piece 34. The baffle 342 is located outside of the upward flange 3311, that is to say, the upward flange 3311 is located within the space surrounded by the pressing piece 34, the baffle 342, and the downward flange 341. The water vapor in the second washing cylinder 32 leaks from the sliding piece 331 and then is blocked by the baffle plate 342, and therefore the water vapor is further prevented from leaking through the gap between the sliding piece 331 and the outer cylinder cover 321, and meanwhile, the upward flange 3311 can be limited to move back and forth within the space enclosed by the pressing piece 34, the baffle 342 and the downward flange 341, also further improves the stability of sliding, as shown in FIG. 13 to FIG. 14.

There are many ways to mount the pressing piece 34 on the outer cylinder cover 321, such as screwing connection. In this embodiment, a plurality of mounting cylinders 3212 are disposed on the outer cylinder cover 321. Screw holes corresponding to the mounting cylinders 3212 are opened on the pressing pieces 34, and the pressing pieces 34 are fixed to the mounting cylinders 3212 by screws. Preferably, the height of the mounting cylinder 3212 is equal to or slightly larger than the height of the baffle 342. In order to improve the stability after mounting the pressing piece 34, connecting plates connecting adjacent mounting cylinders are arranged between the adjacent mounting cylinders 3212. The height of the connecting plate is equal to the height of the mounting cylinder 3212. After mounting the pressing piece 34, the lower surface of the pressing piece 34 contacts the upper surface of the mounting cylinder 3212 and the upper surface of the connecting plate so that the connecting plate also serves to support the pressing plate 34 while reinforcing the mounting cylinder 3212, the pressing piece 34 is more stable after installation.

In order to reduce the cost of the inner cover 33, the inner cover 33 is preferred designed to be as thin as possible, but the strength of the inner cover 33 should be ensured in the meanwhile. Therefore, the inner cover 33 is designed to be of an upward arched shape so as to increase the strength of the inner cover 33. The height of the inner cover 33 is gradually increased from the edge to the center. The height of the center of the inner cover 33 corresponding to the outer cylinder cover 321 is the largest. The inner cover 33 is also attached to the outer cylinder cover 32 so as to increase the tightness preventing the leakage of water vapor in the second inner cover 33. The outer periphery of the inner cover 33 is provided with horizontal sealing edges, that is to say, the outer periphery of the arched structure extends outward to form the horizontal sealing edges, and the horizontal sealing edges attach to the outer cylinder cover 321 to ensure that the inner cover 33 is in close contact with the outer cylinder cover 321 in the closing position. The sealing edges of the inner cover 33 are the sliding pieces mentioned above.

In order to further prevent leakage of the water vapor in the second washing cylinder 32, a stopper baffle 3213 is further provided at the rear end of the outer cylinder cover 321. When the inner cover 33 is in the closing position, the rear end of the inner cover 33 attaches to the stopper baffle 3213, referring to FIG. 12.

When the inner cover 33 slides back and forth, the inner cover 33 is locked by the positioning structure provided when the inner cover 33 slides to the closing position to close the clothes access. Specifically, a positioning structure is provided between the inner cover 33 and the outer cylinder cover 321, and the positioning structure includes a positioning cylinder and a slot. In this embodiment, a positioning cylinder 3214 is provided on the upper surface of the front part of the outer cylinder cover 321, and a slot 332 is provided on the lower surface of the inner cover 33. When the inner cover 33 slides rearwards to the closing position for closing the clothes access 3211, the slot 332 on the inner cover 33 just engages with the positioning cylinder 3214 so that the inner cover 33 is prevent from sliding backwards; and the slot 332 engages with the positioning cylinder 3214 so that the inner cover 33 is prevented from moving forwards, shown as in FIG. 10 to FIG. 15.

In other implementations, a slot may be provided on the outer cylinder cover 321, and a mounting cylinder may be disposed on the inner cover 33.

Figure 15:
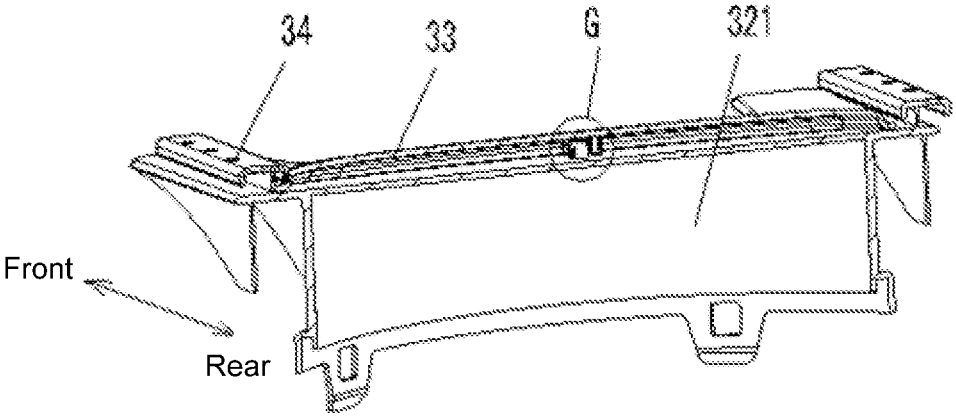
FIG. 15 is a schematic sectional view of the positioning in the outer cylinder cover of FIG. 11.
Figure 16:
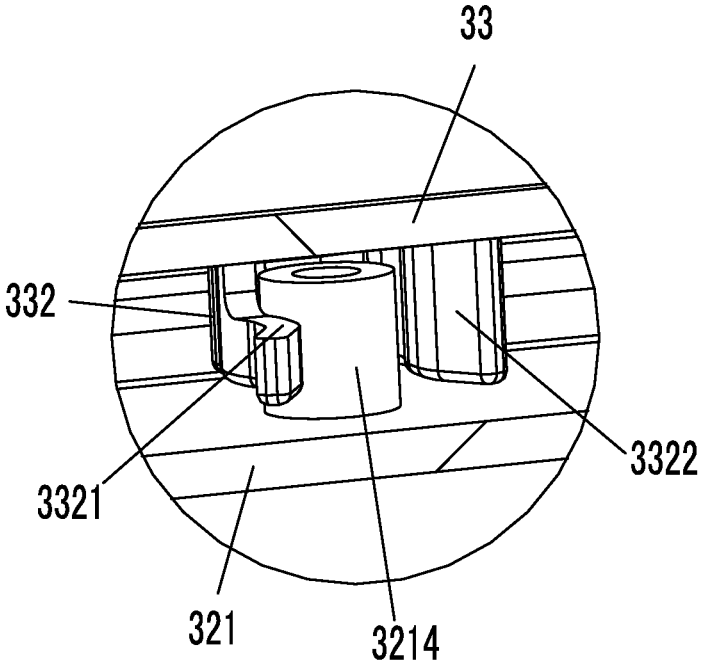
FIG. 16 is a schematic enlarged view of the G region in FIG. 15.
Figure 17:
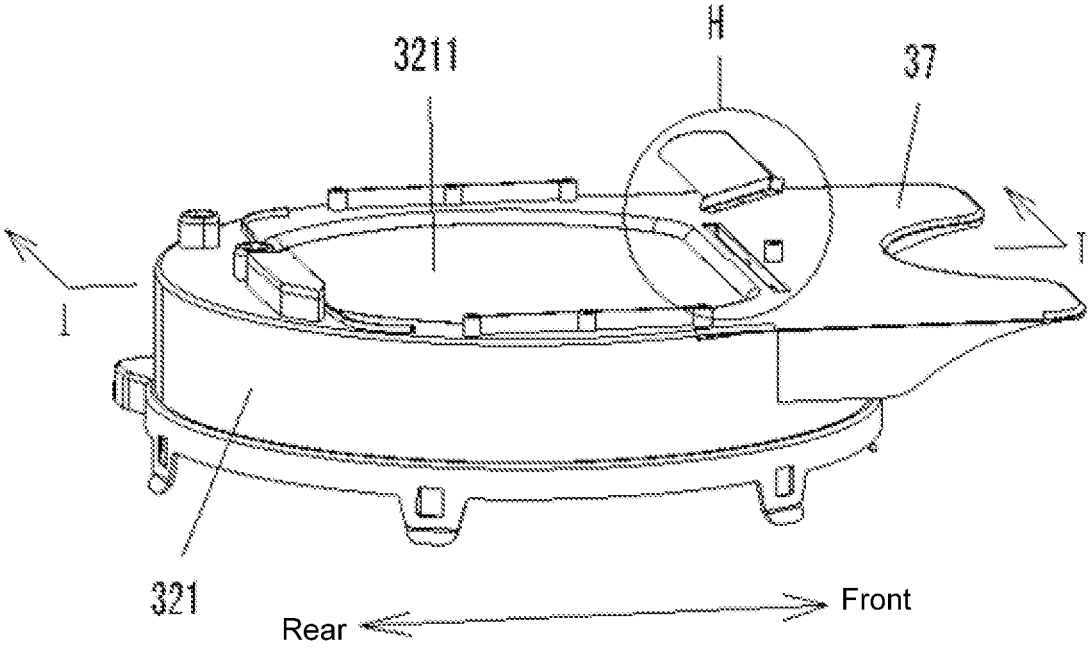
FIG. 17 is a partial schematic view of FIG. 11.

Referring to FIG. 15 to FIG. 16, the slot 332 is disposed on the lower surface of the inner cover 33. Since merely the edge of the inner cover 33 is in contact with the outer cylinder cover 321, the other part of inner cover is in an arched shape, the slide of the inner cover does not be blocked by the positioning cylinder 3214 on the outer cylinder cover 321. The slot 332 is a "C" shaped slot and the opening of the shaped slot faces forwards. A flexible claw 3321 inwardly bent is provided at one end of the slot 332. The lower portion of one end of the slot 332 is connected with the claw 3321, that is to say, the height of the claw 3321 is smaller than the height of the slot 332. When the positioning cylinder 3214 is located in the slot 332, the claw 3321 engages with the positioning cylinder 3214, so that the positioning cylinder 3214 does not detach from the slot 332. That is to say, when the inner cover 33 is in the closing position, the slot 332 and the positioning cylinder 3214 are locked to ensure that the inner cover 33 is closed even that the second automatic washing system vibrates, shakes or the like during the washing cycle of. When the washing cycle is finished, the inner cover 33 needs to be manually pushed forwards to enable the slot 332 detach from the positioning cylinder 3214, and then the inner cover 33 is opened. In order to ensure that the positioning cylinder 3214 is easy to enter the slot 332 as closing the inner cover 33, an outward flange is provided at an end of the claw 3321, and the other end of the slot 332 extends outwards to form a guiding portion 3322. When the inner cover moves backwards to close the clothes access, as the positioning cylinder at the position between the outward flange at the end portion of the claw 3321 and the guiding portion 3322, the positioning cylinder 3214 is guided by the outward flange and the guiding portion 3322 and the positioning cylinder 3214 could be easily enters into the slot 332 and be engaged with.

Figure 19:
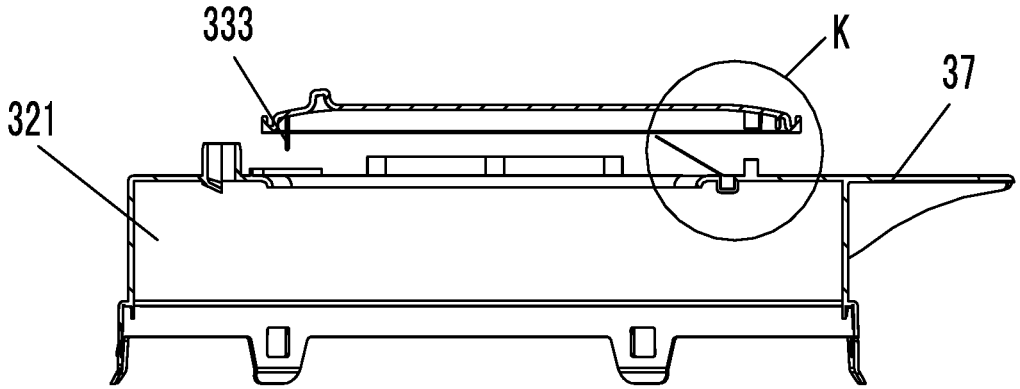
FIG. 19 is a cross-sectional schematic view of FIG. 17 along the line I-I.

A stopper 333 is further disposed at the rear end of the lower surface of the inner cover 33, when the inner cover 33 slides forwards to open the clothes input access 311, the inner cover 33 begins to enter the receiving area. When the inner cover 33 reaches the open position, the stopper 333 is in contact with the front end of the clothes access 3211, and the inner cover 33 is prevent from moving forward to detach from the outer cylinder cover 321, as shown in FIG. 19.

Figure 10:
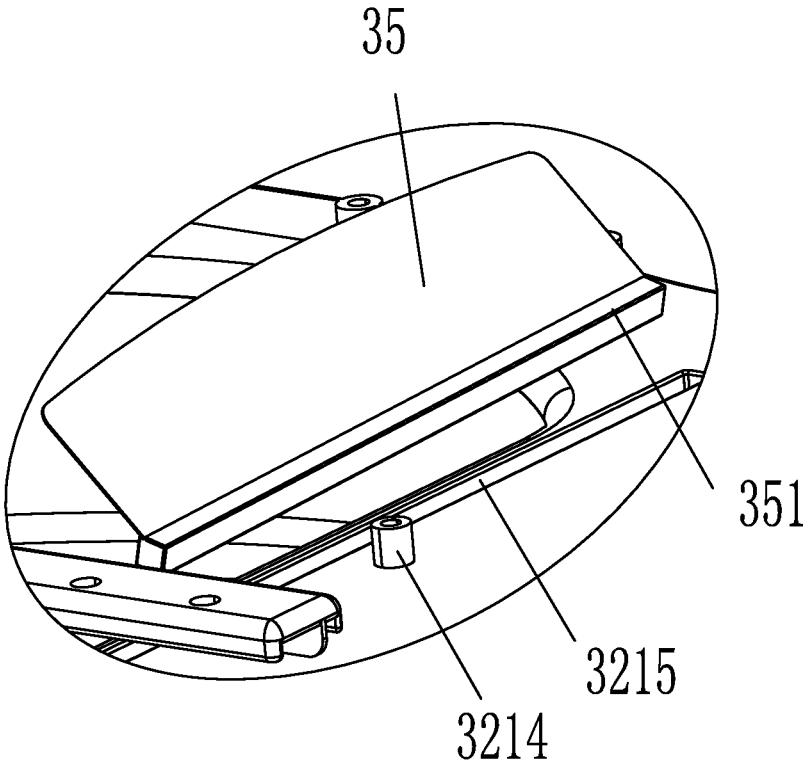
FIG. 10 is an enlarged schematic view of the region D in FIG. 9.

As shown in the FIG. 9 to FIG. 11, since the outer cylinder cover 321 and the second washing cylinder 32 have the same outer diameter, when the inner cover 33 is opened, the inner cover 33 moves forwards into the receiving area, and the front portion of the inner cover 33 gradually detaches from the outer cylinder cover 321. In order to hold the inner cover 33 and ensure the horizontal sliding of the inner cover 33 and the tightness between the inner cover 33 and the outer cylinder cover 321, a support plate 37 is provided in front of the outer cylinder cover 321. The upper surface of the support plate 37 and the upper surface of the outer cylinder cover 321 are in the same horizontal plane. When the inner cover 33 is opened, the inner cover 33 slides from the outer cylinder cover 321 towards the support plate 37. In this embodiment, the support plate 37 is of a shape of dovetail, and mainly supports the sliding pieces 331 on the left and right sides of the inner cover 33. By providing the supporting plate 37, the horizontal sliding of the inner cover 33 is ensured, the deformation of the sliding piece 331 caused by the problem that the front of the inner cover 33 is dangled and drooped when the inner cover 33 is opened is avoided, so as to ensure the tightness between the inner cover 33 and the outer cylinder cover 321.

Referring to FIG. 9 to FIG. 11, as well as FIG. 17 to FIG. 20, the structure of a wiping plate provided on the outer cylinder cover of the second automatic washing system 3 is illustrated. For example, when the second automatic washing system 3 starts to work, the heating function is activated. The water vapor moves upward and encounters with the closed inner cover 33, and part of the water vapor condenses on the lower surface of the inner cover 33 and become water droplets. When the washing cycle is finished, the inner cover 33 is with water droplets. In order to prevent water on the inner cover 33 dropping on the shell 1, the wiping plate 35 is disposed in the front of the outer cylinder cover 321. The wiping plate 35 is in contact with the lower surface of the inner cover. When the inner cover 33 is opened, the wiping plate 35 removes water droplets from the lower surface of the inner cover 33. The arrangement of the wiping plate 35 could avoid water on the lower surface of the inner cover 33 dropping on the outer cylinder and finally dropping on the base frame of the shell resulting in corrosion or dropping on the electrical elements resulting in electric leakage. Therefore, the safety of the washing machine is increased and the service life is prolonged.

Figure 20:
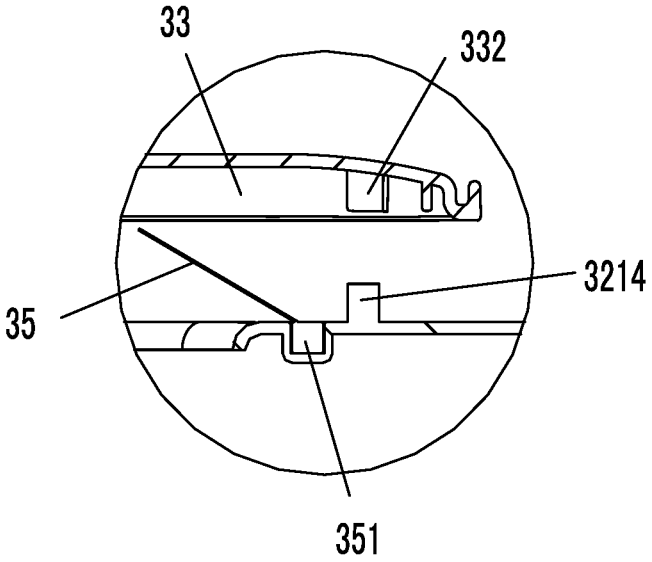
FIG. 20 is an enlarged schematic view of the K region in FIG. 19.

The wiping plate 35 is a thin plate and disposed on the outer cylinder cover 321. The inner cover is in an upwardly arched structure, the upper part of the wiping plate 35 is in contact with the inner cover 33 by the means that the wiping plate 35 is tilted upward. When the inner cover 33 is opened, the water droplets on the lower surface of the inner cover 33 are blocked by the wiping plate 35. Preferably, the wiping plate 35 is tilted backwards, that is to say, towards the closing direction of the cover 33. The wiper plate body 352 is disposed at an angle from 10° to 90° with respect to the horizontal plane where the outer cylinder cover 321 is in. The position where the upper part of the wiping plate 35 is in contact with the inner cover is above the clothes access 3211 so that the scraped water drops directly into the inner cylinder. The sliding direction of the inner cover 33 when opened is opposite to the direction of inclination of the wiping plate 35 so that the wiping plate 35 and the inner cover 33 fit more closely and water droplets on the lower surface of the inner cover 33 are more thoroughly scraped off, as shown in FIG. 19 and FIG. 20.

The angle between the wiping plate 35 and the plane of the outer cylinder cover 321 is preferably 10° to 30° or the angle between the wiping plate body 352 and the horizontal surface of the clothes access 3211 is preferably 10° to 30°. Preferably, the angle between the wiping plate body 352 and the inner surface of the outer cylinder cover 321 is 25°. The wiping plate 35 is tilted upward by a small angle so that the water droplets on the inner cover 33 removed by the wiping plate 35 falls directly into the inner cylinder rather than flow down along the wiping plate 35.

The wiping plate 35 is made of elastic materials, such as rubber. The wiping plate 35 with great elasticity could be in close contact with the inner cover 33 and therefore the water on the inner cover 33 could be removed cleaner. In other embodiments, it is acceptable only a portion where the wiping plate and the inner cover are in contact is made of elastic material.

When opening the inner cover 33, the upper portion of the wiping plate 35 is in contact with the inner cover 33, and the inner cover 33 exerts a forward force on the wiping plate 35. Therefore, the wiping plate 35 should be firmly fixed to the outer cylinder cover 321. A mounting block 351 is disposed at the lower end of the wiping plate 35. A mounting groove 3215 corresponding to the mounting block 351 is opened on the outer cylinder cover 321, and the mounting block 351 is mounted in the mounting groove 3215. The mounting block 351 and the mounting groove 3215 are both in the shape of a square, so that when the forward force exerted by the inner cover on the mounting block 351, the stress bearing area is comparatively sufficient with good stability, thereby ensuring the firmness of installation. The wiping plate 35 is integrally molded with the mounting block 351. The wiping plate 35 is upwardly tilted relative to the mounting block 351 after molding, and the angle between the wiping plate 35 and the panel where the top surface of the mounting block 351 in is in the range of 10° to 30°, therefore it is ensured that the angle between the wiping plate 35 and the horizontal plane where the outer cylinder cover 321 is located is 10° to 30° after the mounting block 351 is installed in the mounting groove 3215, which ensures the wiping function of the wiping plate 35.

Figure 18:
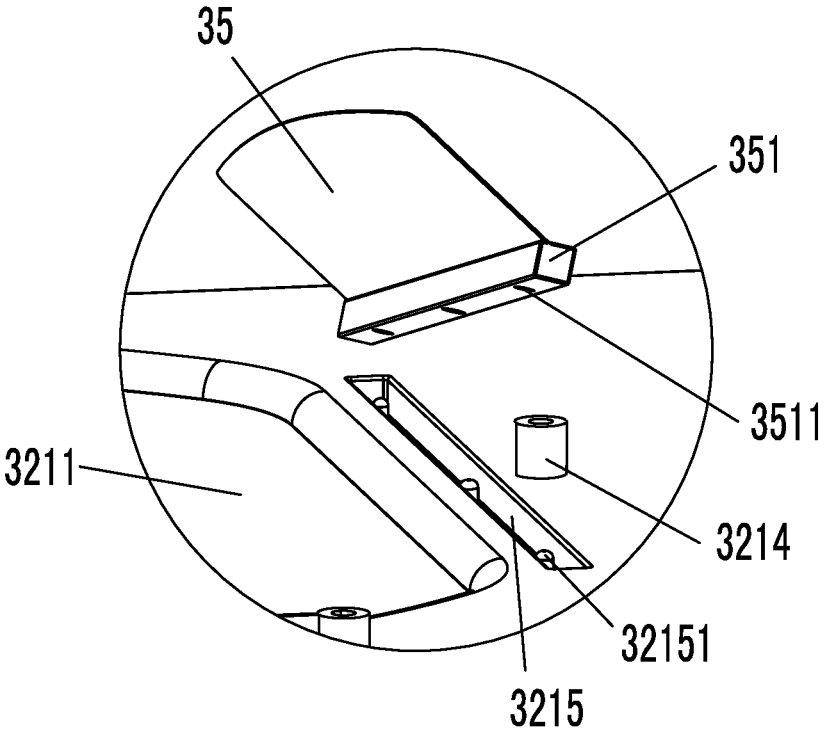
FIG. 18 is a schematic enlarged view of the H region in FIG. 17.

A positioning cylinder 3214 is also provided on the front of the outer cylinder cover 321. A mounting groove 3215 is disposed behind the positioning cylinder 3214, as shown in FIG. 18.

In order to further ensure that the wiping plate 35 is firmly fixed on the outer cylinder cover 321, a fixing structure is provided on the mounting groove 3215 and the mounting block 351 in cooperation. The fixing structure includes a fixing hole and a fixing cylinder. In this embodiment, a fixing cylinder 32151 is disposed on the mounting groove 3215, and a fixing hole 3511 corresponding to the fixing cylinder 32151 is opened on the mounting block 351. When the mounting block 351 is mounted to the mounting groove 3215, the mounting cylinder 32151 is inserted into the mounting hole 3511 to further enhance the firmness of the mounting block 351 when the mounting block 351 is mounted to the mounting groove 3215. The height of the fixing hole 3511 on the mounting block 351 is smaller than the height of the mounting block 351, that is to say, the fixing hole 3511 is a blind hole. After the mounting block 35 is mounted on the outer cylinder cover 321, the user is oblivious to the fixing structure and good in looking.

In this embodiment, the water-proof method of the washing machine comprises the following steps: the inner cover 33 is pushed and slid horizontally, and the inner surface of the inner cover 33 passes through the wiping plate body 352 attached to, the water droplets on the inner surface of the inner cover 33 are blocked by the wiping plate body 352, so that there is no water droplet in the portion of the inner cover 33 where the wiping plate body 352 slides. The water droplet drips into the inner cylinder after gathering to some extent at the wiper 1011. In this way, water drops on the surface of the inner cover 33 are prevented from dropping to the ground or dripping off the top of the shell to drip onto the ground to cause inconvenience to the user.

Figure 21:
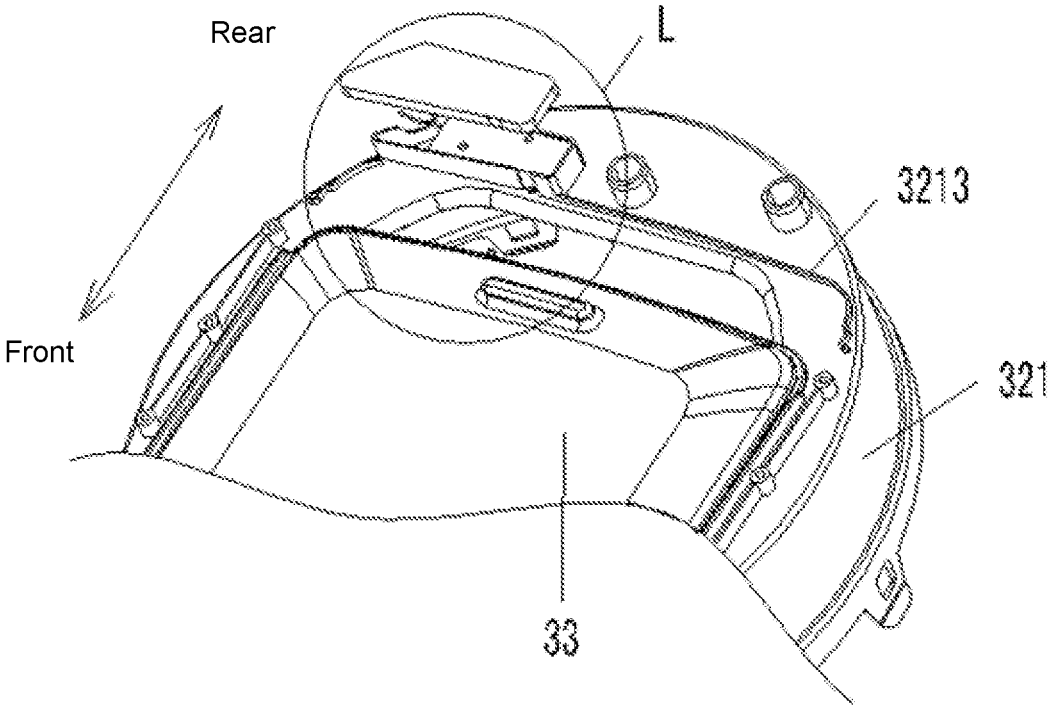
FIG. 21 is a schematic view of a partially enlarged structure at the position of the micro switch in FIG. 11.
Figure 22:
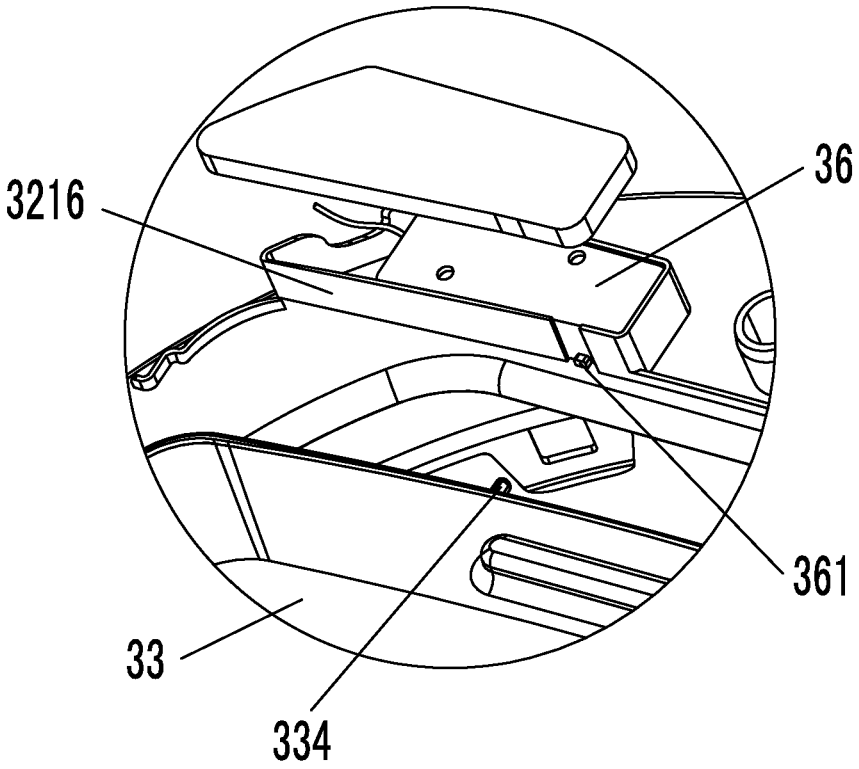
FIG. 22 is an enlarged schematic view of the L region in FIG. 21.

Referring to FIG. 21 and FIG. 22, a description will be given to illustrate the micro switch that interlocks with the inner cover provided on the second automatic washing system 3. The second automatic washing system 3 has a heating function. If the inner cover 33 does not reach the closing position or the inner cover 33 is released from the closing position during the washing cycle, the laundry may be thrown out and water vapor may be leaked out resulting in problems as corrosion or burning. In order to solve the problem, a micro switch 36 triggered by the inner cover 33 is provided on the outer cylinder cover 321. When the inner cover 33 is in the closing position, the micro switch 36 is on and the second automatic washing system 3 can start to work; when the inner cover 33 is opened, that is to say, the inner cover 33 leaves the closing position and the micro switch 36 is off. The micro switch 36 is connected in series in the control circuit of the second automatic washing system 3. If the inner cover 33 is not in the closing position and the micro switch 36 is off, the second automatic washing system 3 is not allowed to start to work even receiving signals from the display operation module. As the second automatic washing system 3 enters into the washing cycle, the inner cover 33 is opened and released from the closing position, and the second automatic washing system 3 is stopped immediately. By providing the micro switch 36 actuated by the inner cover 33, it is ensured that the inner cover 33 is in the closing position during the washing process of the second automatic washing system 3, the leakage of water vapor, clothes thrown out, burning and collision are prevented.

In this embodiment, as shown in FIG. 21 and FIG. 22, the micro switch 36 is disposed at the rear part of the outer cylinder cover 321. A switch actuator 361 protruding forwards is provided on the front end surface of the micro switch 36. When the inner cover 33 is at the closing position, the inner cover 33 is in contact with the switch actuator 361 to actuate the micro switch 36. Owing to the displacement that the inner cover 33 slides back and forth to open or close and the micro switch 36 is provided with a switch actuator 361 protruding forward, when the inner cover 33 is being closed, the inner cover 33 slides forwards until it reaches the closing position where the rear end surface of the inner cover 33 presses against the switch actuator 361 to trigger the micro switch 36, that is to say, the front end of the inner cover 33 serves as the actuator and there is no need to provide further actuator on the inner cover 33. The structure of the actuator is simple with low cost.

In order to prevent water droplets from falling on the micro switch 36, the micro switch 36 is arranged inside the casing 3216, and the casing 3216 is fixed on the outer cylinder cover 321. A through hole from where the switch actuator 361 penetrates is opened at the front wall of the casing 3216. The casing 3216 is designed to ensure the reliability of the micro switch 36 by preventing the water droplets falling on the micro switch 36 which may reduce the service life of the micro switch 36. The casing 3216 includes a casing body and an upper cover, wherein the casing body and the outer cylinder cover 321 is integral by molding.

Referring to FIG. 22, the switch actuator 361 placed in the casing 3216 protrudes from the though hole but does not protrudes out of the casing 3216 to avoid being wrongly pressed. Further, a trigger 334 corresponding to the switch actuator 361 is provided on the inner cover 33 and the trigger 334 protrudes backwards out of the inner cover; when the inner cover 33 is at the closing position, the trigger 334 presses against the switch actuator 361 backwards to actuate the micro switch 36.

A stopper baffle 3213 is provided at the rear part of the outer cylinder cover 321 to ensure the tightness as the inner cover 33 at its closing position. To be specific, the rear end surface of the inner cover 33 is attached to the stopper baffle 3213 and the front end surface of the inner cover 33 is attached to the front end surface of the casing 3216, namely part of the front end surface of the casing 3216 serves as a part of the stopper baffle 3213, or that is to say the stopper baffle 3213 is broken at the position of the casing 3216.

The above description is only the preferred embodiments of the present invention, but not intended to limit the present invention in any other form. Any skilled person familiar with the art may use the disclosed technical solution to acquire equivalent embodiments merely by simple modifications. Various modifications thereof not departing from the spirit and scope of the present invention may also fall within the scope of the disclosure.

What we claimed is:

1. A washing machine with dual washing systems comprising: a shell, a first automatic washing system and a second automatic washing system, wherein the first automatic washing system and the second automatic washing system are disposed in the shell; the shell has a first washing area accommodating the first automatic washing system and a second washing area accommodating the second automatic washing system, the first washing area and the second washing area are arranged along the direction from left to right; the axis of the first automatic washing system is perpendicular to the axis of the second automatic washing system;

wherein the second automatic washing system includes the second washing cylinder, an outer cylinder cover is arranged on the second washing cylinder, a clothes access and an inner cover sliding to open and close the clothes access are provided on the outer cylinder cover and a receiving area for receiving the opening inner cover is provided inside the shell;

wherein the outer cylinder cover is provided with a wiping plate slidingly in contact with the inner cover so that when the inner cover is opened, the wiping plate slides on the inner cover and removes water droplets from the lower surface of the inner cover; and wherein the wiping plate is disposed at an angle from 10° to 90° with respect to a horizontal plane where the outer cylinder cover is in.

2. The washing machine with dual washing systems according to the claim 1, wherein the axis of the first automatic washing system and the axis of the second automatic washing system are perpendicular to each other but are not intersecting.

3. The washing machine with dual washing systems according to the claim 1, wherein one of the first automatic washing system and the second automatic washing system is a fully automatic drum-type washing system, and the other one is a fully pulsator-type automatic washing system, and a water supply system and a drainage system is used by the first automatic washing system and the second automatic washing system together.

4. The washing machine with dual washing systems according to the claim 1, wherein a control system controls the first automatic washing system and the second automatic washing system and the spin cycle of the first automatic washing system and the second automatic washing system starts at different time under the control of the control system.

5. The washing machine with dual washing systems according to the claim 4, wherein the washing machine further has a display operation module disposed on the top of an auxiliary functional area.

6. The washing machine with dual washing systems according to the claim 1, wherein the shell has an auxiliary functional area adjacent to the first washing area and the second washing area; the auxiliary functional area and the second washing area are arranged back and forth; the auxiliary functional area and the first washing area are disposed along the direction from left to right.

7. The washing machine with dual washing systems according to claim 1, wherein the first automatic washing system comprises a first washing cylinder, the second automatic washing system comprises a second washing cylinder, and the minimum distance between the first washing cylinder and the second washing cylinder is 15 mm to 30 mm.

8. The washing machine with dual washing systems according to claim 1, wherein the shell includes a left side plate, a right side plate, a back plate, and an L-shaped sealing plate, the front end of the left side plate is bent to the right and extended to form a front plate, the rear end of the left side plate is bent to the right to form a right rear plate; the rear end of the right side plate is bent to the left to form a left rear plate, the back plate is arranged between the right rear plate and the left rear plate; the L-shaped sealing plate has a first portion in the front-rear direction in which the front plate is connected to, and a second portion in the left-right direction in which the right side plate is connected to.

9. The washing machine with dual washing systems according to claim 1, wherein the wiping plate is disposed at an angle from 10° to 30° with respect to the horizontal plane where the outer cylinder cover is in.

10. The washing machine with dual washing systems according to claim 1, wherein the wiping plate is made of an elastic material or a portion of the wiping plate where the wiping plate and the inner cover are in contact is made of the elastic material.

11. The washing machine with dual washing systems according to claim 1, wherein the wiping plate is firmly fixed to the outer cylinder cover through a mounting block mounted in a mounting groove; and wherein the mounting block is disposed at a lower end of the wiping plate, and the mounting groove is provided on the outer cylinder cover.

12. The washing machine with dual washing systems according to claim 11, wherein the wiping plate is integrally molded with the mounting block.

13. The washing machine with dual washing systems according to claim 11, wherein a fixing cylinder is disposed in the mounting groove, and a fixing hole corresponding to the fixing cylinder is provided in the mounting block; and the fixing cylinder is mounted in the fixing hole.

14. A washing machine with dual washing systems comprising: a shell, a first automatic washing system and a second automatic washing system, wherein the first automatic washing system and the second automatic washing system are disposed in the shell; the shell has a first washing area accommodating the first automatic washing system and a second washing area accommodating the second automatic washing system, the first washing area and the second washing area are arranged along the direction from left to right; the axis of the first automatic washing system is perpendicular to the axis of the second automatic washing system;

wherein the second automatic washing system includes the second washing cylinder, an outer cylinder cover is arranged on the second washing cylinder, a clothes access and an inner cover sliding to open and close the clothes access are provided on the outer cylinder cover and a receiving area for receiving the opening inner cover is provided inside the shell; and wherein the outer cylinder cover is provided with a wiping plate slidingly in contact with the inner cover so that when the inner cover is opened, the wiping plate slides on the inner cover and removes water droplets from the lower surface of the inner cover;

wherein the wiping plate is disposed at an angle from 10° to 30° with respect to a horizontal plane where the outer cylinder cover is in;

wherein the wiping plate is made of an elastic material or a portion of the wiping plate where the wiping plate and the inner cover are in contact is made of the elastic material;

wherein the wiping plate is firmly fixed to the outer cylinder cover through a mounting block mounted in a mounting groove; and wherein the mounting block is disposed at a lower end of the wiping plate, and the mounting groove is provided on the outer cylinder cover;

wherein the wiping plate is integrally molded with the mounting block; and wherein a fixing cylinder is disposed in the mounting groove, and a fixing hole corresponding to the fixing cylinder is provided in the mounting block; and the fixing cylinder is mounted in the fixing hole.

* * * * *